US008522663B2

(12) United States Patent
Drever

(10) Patent No.: US 8,522,663 B2
(45) Date of Patent: Sep. 3, 2013

(54) MULTILAYERED BALLISTIC PROTECTION

(75) Inventor: Michael Drever, Houston, TX (US)

(73) Assignee: Expandable Structures, LLC, Houston, TX (US)

( * ) Notice: Subject to any disclaimer, the term of this patent is extended or adjusted under 35 U.S.C. 154(b) by 480 days.

(21) Appl. No.: 12/618,721

(22) Filed: Nov. 14, 2009

(65) Prior Publication Data

US 2010/0122626 A1 May 20, 2010

Related U.S. Application Data

(60) Provisional application No. 61/114,885, filed on Nov. 14, 2008.

(51) Int. Cl.
*F41H 5/007* (2006.01)

(52) U.S. Cl.
USPC ..... 89/36.02; 89/902

(58) Field of Classification Search
USPC ..... 89/36.01, 36.02, 36.04, 36.17, 902; 109/20, 29
See application file for complete search history.

(56) References Cited

U.S. PATENT DOCUMENTS

| | | | | | |
|---|---|---|---|---|---|
| 3,708,194 | A * | 1/1973 | Amit | 293/1 |
| 4,098,035 | A | 7/1978 | Bessler | |
| 4,482,414 | A | 11/1984 | Schonberger | |
| 4,543,872 | A * | 10/1985 | Graham et al. | 86/50 |
| 5,025,707 | A * | 6/1991 | Gonzalez | 89/36.17 |
| 5,217,185 | A * | 6/1993 | Rucker | 244/121 |
| 5,739,458 | A * | 4/1998 | Girard | 89/36.02 |
| 6,029,558 | A * | 2/2000 | Stevens et al. | 89/36.17 |
| 6,279,449 | B1 * | 8/2001 | Ladika et al. | 89/36.17 |
| 6,289,642 | B1 | 9/2001 | Diamond | |
| 6,308,491 | B1 | 10/2001 | Porter | |
| 6,370,829 | B2 | 4/2002 | Diamond | |
| 6,412,391 | B1 * | 7/2002 | Stevens et al. | 89/36.17 |
| 6,439,100 | B1 * | 8/2002 | Jung et al. | 89/36.01 |
| 6,439,120 | B1 | 8/2002 | Bureaux et al. | |
| 6,595,102 | B2 * | 7/2003 | Stevens et al. | 89/36.17 |
| 7,178,445 | B2 * | 2/2007 | Wulvik et al. | 89/36.02 |
| 7,963,075 | B2 * | 6/2011 | Howland | 52/202 |
| 2002/0152881 | A1 * | 10/2002 | Stevens et al. | 89/36.17 |
| 2006/0027088 | A1 * | 2/2006 | Wulvik et al. | 89/36.02 |
| 2007/0113486 | A1 * | 5/2007 | Howland | 52/1 |

OTHER PUBLICATIONS

Atlantic Shutter Systems, Storm Rated Shutter Certification, <Nov. 14, 2008.

* cited by examiner

*Primary Examiner* — Jonathan C Weber
(74) *Attorney, Agent, or Firm* — Carrie A. Boone, P.C.

(57) ABSTRACT

A multilayered ballistic protection assembly for windows is disclosed. The multilayered ballistic protection assembly consists of a tough resistant material that absorbs impacts, separated by deflecting "stroking" volumes that allow movement of the resistance layer without causing breakage of the underlying glass window. The resistance layer exhibits extraordinary in-plane strength with only a marginal out-of-plane strength. The multilayered ballistic protection assembly may vary considerably in material strength and assembly, depending on its intended use. The number of layers making up the assembly is determined by the degree of desired protection, the size of the object to be protected, and the strength of the resistance and stroking materials used to protect the object. Among other applications, the multilayered ballistic protection assembly is designed to protect glass from impacts due to severe weather and other debris-generating hazards.

23 Claims, 12 Drawing Sheets multilayered ballistic protection assembly (100A)

multilayered ballistic protection assembly (100B)

MULTILAYERED BALLISTIC PROTECTION

CROSS-REFERENCE TO RELATED APPLICATIONS

This application claims priority under 35 U.S.C. 119(e) to U.S. Provisional Patent Application No. 61/114,885, entitled, "MULTILAYERED BALLISTIC PROTECTION FOR WINDOWS", filed on Nov. 14, 2008.

TECHNICAL FIELD

This application relates to window protection and, more particularly, to a window protection product that provides several performance advantages over other solutions.

BACKGROUND

Home and business owners in storm-prone areas know that, for maximum safety and protection of their belongings, their windows should be covered to prevent the penetration of flying debris. Unprotected windows may easily break during storms, causing water and other damage to the contents of the dwelling.

When advanced warning of such storms is available, as in the case of hurricanes, property owners often scramble to obtain some protection for the windows. Typical resolutions to the problem of securing a dwelling are to use a rigid panel to cover the windows (plywood, corrugated plastic, etc), to place tensioned fabric offset from the window, or to provide no protection at all. Preferably, the window has more permanent fixtures available, such as shutters, louvres, rolled louvres, and others. When installed correctly, these solutions generally provide effective storm protection.

The protection of orbiting spacecraft may be instructive. Satellites in orbit have to protect against the continual threat of micro-meteor and orbital debris (MMOD). Custom shielding is designed to break up hypervelocity particles that may damage the spacecraft. This custom shielding often uses layering to spread out the impact and disperse it by allowing subsequent layers of material to be destroyed until the impact momentum is spread across a large enough area that the forces are too low to damage the spacecraft.

While plywood is an effective, affordable solution, it is not convenient for all property owners. The property owner needs carpentry tools to cut the plywood to the proper size for each window and the skills to safely do so. By applying dense armor to cover the window, plywood is good for protection, but is unwieldy, particularly for larger windows. Plywood is increasingly hazardous to install in second and third floor windows without assistance. Once the storm has passed, the plywood consumes valuable storage space when not in use, and serves no useful function until the next storm.

There are known methods for maintaining programmed gaps between resistance layers. The columns of historic buildings built during the Roman Empire are illustrative. These buildings are designed using compressible shapes (parallel columns) between resistance layers to add structural integrity to the building and to maintain parallelism or other programmed gaps between parts of the building.

Thus, there is a continuing need for an alternative but effective window protection mechanism.

BRIEF DESCRIPTION OF THE DRAWINGS

The foregoing aspects and many of the attendant advantages of this document will become more readily appreciated as the same becomes better understood by reference to the following detailed description, when taken in conjunction with the accompanying drawings, wherein like reference numerals refer to like parts throughout the various views, unless otherwise specified.

DETAILED DESCRIPTION

In accordance with the embodiments described herein, a multilayered ballistic protection assembly for windows is disclosed. The multilayered ballistic protection assembly consists of a tough resistant material that prevents penetration of objects and distributes impacts to separate energy absorbing "stroking" volume(s). The stroking volume(s) absorb the energy of an impact without causing breakage of the underlying glass window or other fragile surface being protected.

As described herein, the multilayered ballistic protection assembly may vary considerably in material strength and assembly, depending on its intended use, cost, and other factors. In some embodiments, the number of layers making up the assembly is determined by the degree of desired protection, the size of the object to be protected, and the strength of the resistance and stroking materials that make up the assembly. Among other applications, the multilayered ballistic protection assembly is designed to protect glass from impacts due to severe weather and other debris-generating hazards.

In the following detailed description, reference is made to the accompanying drawings, which show by way of illustration specific embodiments in which the invention may be practiced. However, it is to be understood that other embodiments will become apparent to those of ordinary skill in the art upon reading this disclosure. The following detailed description is, therefore, not to be construed in a limiting sense, as the scope of the present invention is defined by the claims.

Figure 1:
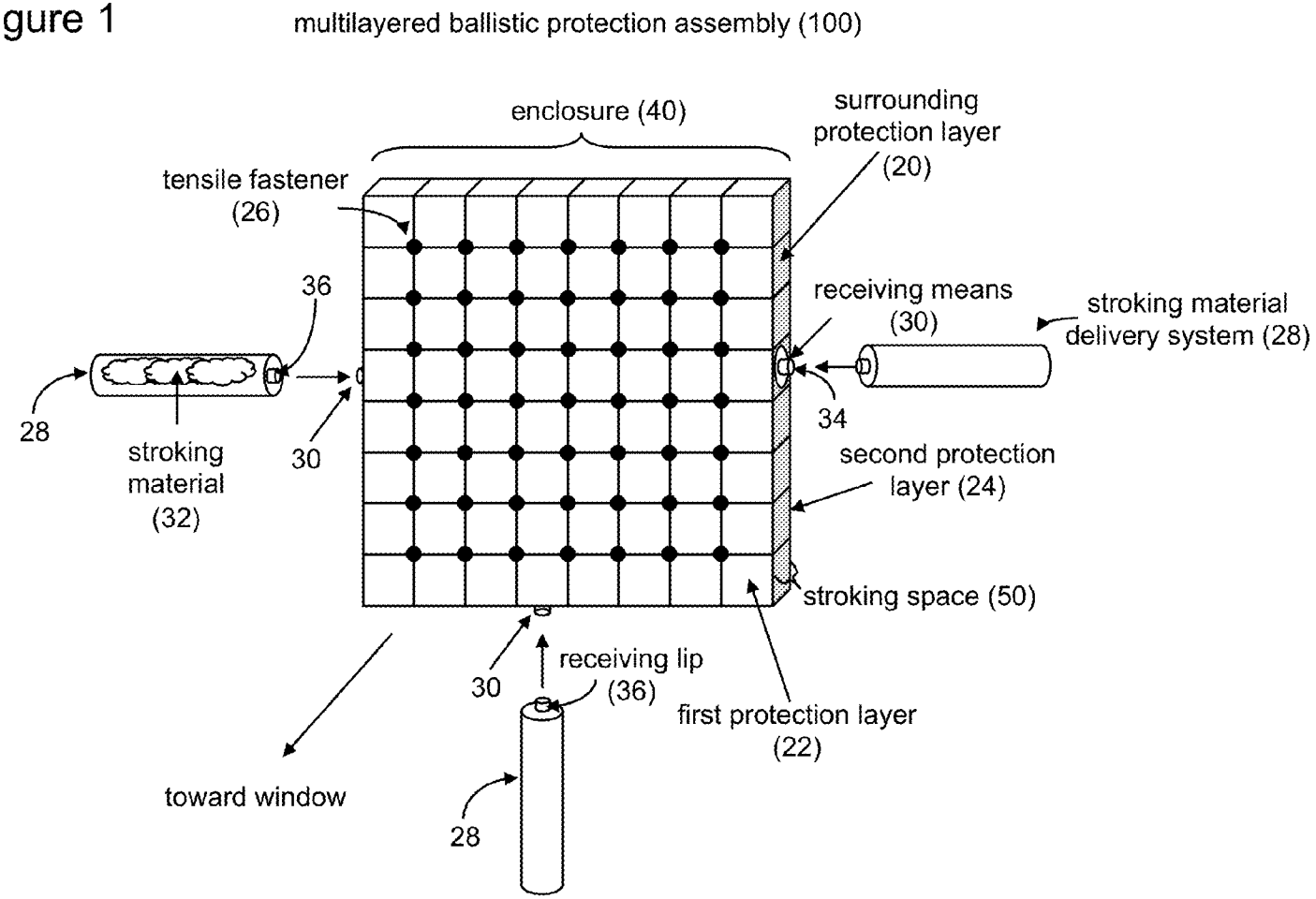
FIG. 1 is a schematic diagram of a multilayered ballistic protection assembly, according to some embodiments.

FIG. 1 is a schematic block diagram of a multilayered ballistic protection assembly 100, according to some embodiments. The multilayered ballistic protection assembly 100 consists of an enclosure 40 that, in the depiction of FIG. 1, assumes a rectangular cubic shape much like an air mattress. The enclosure 40 includes a first protection layer 22, a second protection layer 24, and a surrounding protection layer 20. Tensile fasteners 26 occupying a stroking space 50 are arranged between the first protection layer 22 and the second protection layer 24 to control the shape of the enclosure.

The enclosure 40 is designed to contain the stroking material 32. As used herein, an enclosure is defined as a closed structure from which the stroking material 32 will not escape. The enclosure 40, while being capable of changing shape, such as being folded into a compact form, assumes a predefined shape when the stroking material 32 is activated. There are several different embodiments described herein for activating the stroking material.

In some embodiments, the layers 22, 24, and 20 that constitute the enclosure 40 are made from an anisotropic woven material, such as fiberglass fabric. In other embodiments, the layers 22, 24, and 20 are made using isotropic materials, such as metal or plastics. In still other embodiments, the enclosure 40 is made using multiple distinct materials arranged into a composite form. Suitable materials for the multilayered ballistic protection assembly 100 include, but are not limited to, cotton, nylon, kevlar, carbon fiber, arimid fibers, perforated metal foils, thin wood, plastics, resin-filled fiberglass, and plastic-bonded fabrics.

Figure 2:
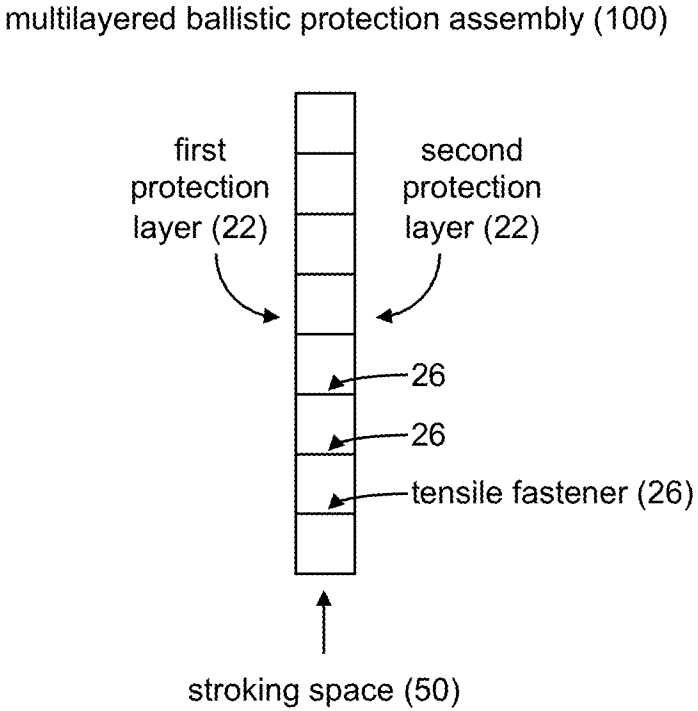
FIG. 2 is a side view of the protection assembly of FIG. 1, according to some embodiments.

FIG. 2 is a side view of the protection assembly 100, showing how the tensile fasteners 26 are threaded between the two layers in the stroking space 50. The tensile fasteners 26 may be made using a material that only resists tensile loads, such as rope or string, or using materials that can withstand tension and compression, such as a column of wood, plastic, ceramic, or metal. Preferably, the tensile fasteners 26 are capable of laying parallel to the layers 22, 24 before assembly so that the protection assembly 100 may be in a compact (initial) configuration. The tensile fasteners 26 control the distance between the protection layers 22, 24 and force the enclosure 40 to take a preprogrammed shape.

In some embodiments, the tensile fasteners are thin strips of plastic, such as fishing wire. These are a type of tension-only tensile fasteners. The plastic strips are sufficient to add structural integrity to the assembly 100 as it assumes the preprogrammed shape when the stroking material 32 is inserted within the enclosure 40. In other embodiments, the tensile fasteners 26 are straws or other column-shaped structures, or tension and compression fasteners. Whether plastic strips, straws, or other structures, the tensile fasteners 26 lay flat against the two layers 22, 24 when the assembly is in its initial or interim configurations (see FIG. 5, below). The straws or other column-shaped structures confine the volume of the stroking material in a structural shape equivalent to a column. This forces the resistance layers to follow a predefined path while increasing strength as needed.

Figure 3:
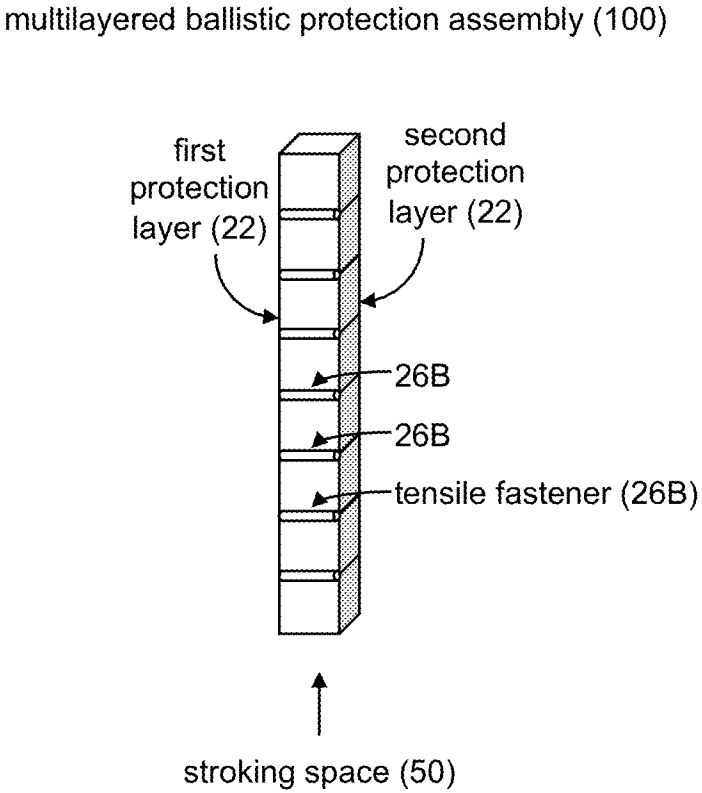
FIG. 3 is a side view of a protection assembly having cylindrical tensile fasteners, according to some embodiments.

FIG. 3 is a side view of the multilayered ballistic protection assembly 100, showing cylindrically shaped tensile fasteners 26B. In some cases, arched shapes may be desirable for strength over longer spans, specific designs for sliding glass doors versus narrower windows.

In other embodiments, the tensile fasteners 26 are made using a material that can rotate and stand up to create the stroking volume. For example, the tensile fasteners 26 may be metal pieces that are formed to be curved in a free state. When compressed, the metal pieces would flatten and store energy like a spring. When the protection assembly 100 is unfurled to its interim configuration (FIG. 5), a large number of the metal pieces, acting as "springs," would rotate up and create a stand-off distance between the protection layers 22 and 24.

Figure 4:
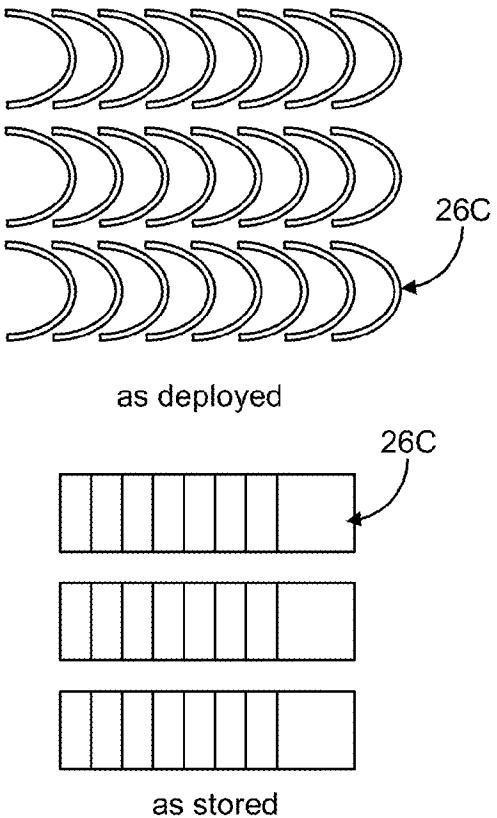
FIG. 4 is a depiction of tensile fasteners in both flattened and spring-like configurations, according to some embodiments.
Figure 4:
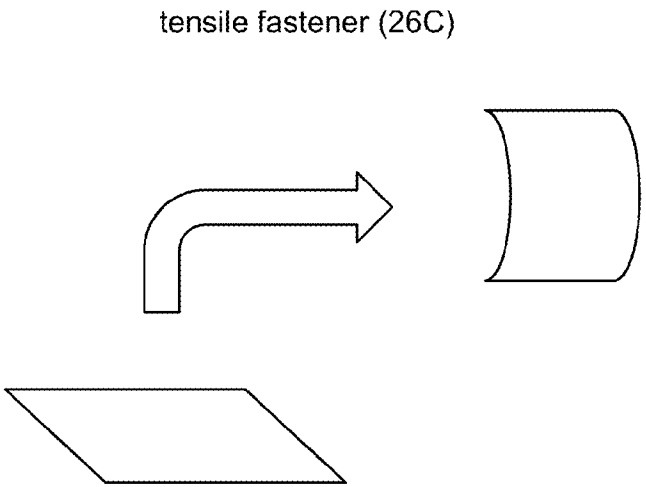

FIG. 4 is a depiction of these alternate tensile fasteners 26C, according to some embodiments. The tensile fastener 26C is a square piece that lays flat when not in use. When used, the tensile fastener 26 assumes a rounded shape that has a spring-like quality. Such fasteners may be part of the multilayered ballistic protection assembly 100.

Returning to FIG. 1, the protection assembly 100 further includes one or more stroking material delivery systems or canisters 28, containing stroking material 32. In the depiction of FIG. 1, the canisters 28 are containers containing pressurized stroking material, such as closed cell foam. Open cell foam is characterized as having interconnected pores that form a relatively soft network of foam material. Closed cell foam, by contrast, lack these interconnected pores. Because of this structure, closed cell foams generally have higher compressive strength than open cell foam. Closed cell foams also do not fill with whatever is surrounding, whether air or water.

Each stroking material delivery systems 28 is connected to the enclosure by a receiving means 30 consisting of an injection port and lip 34. Each receiving means 30 accepts one of the canisters 28 containing the stroking material. Once the canister or canisters 28 are inserted, the contents of the canisters will be transferred to the inside of the enclosure 40. The enclosure 40 receives the stroking material, such as polyurethane foam, until the enclosure is filled up. The tensile fasteners 26 help the enclosure 40 to maintain its desired shape, whether rectangular cubic shaped as in FIG. 1 or some other desired shape.

In the embodiment of FIG. 1, the receiving means 30 are part of the surrounding protection layer 20. The receiving means 30 consists of an injection port with a lip 34, where the injection port is attached to the material of the surrounding protection layer 20, with a hole cut into the layer (not shown) to enable the lip 34 to extend through the hole. The canister 28 likewise includes a receiving lip 36 to fit snugly into the lip 34 before the stroking material 32 is delivered into the enclosure 40. Alternatively, the receiving means 30 may be part of either the first protection layer 22 or the second protection layer.

In other embodiments, the stroking material 32 is not inserted into the enclosure 40, but is already present in the enclosure upon receipt by the customer. The "integrated" stroking material 32 is unactivated when in the initial configuration. The stroking material may be activated by inserting a liquid, such as water, into the enclosure 40. Or, the integrated stroking material may be combined with another material also inside the enclosure 40. In this embodiment, the stroking material is activated without an external catalyst, obviating the need for the enclosure to have any receiving means 30. The integrated stroking material may be activated by some physical act, by a temperature change, or using some other non-invasive means.

If foam is used as the stroking material, closed cell foam will not increase in size if water is applied to the assembly 100, whereas open cell foam operates in a sponge-like manner, changing shape as it absorbs water. Thus, during a severe weather storm, the assembly 100 may change shape if open cell foam is used. For this reason, where an open cell foam is used as the stroking material 32, the foam is protected from exposure to the outside to prevent the foam from taking on water, in some embodiments. A liquid tight enclosure or other sealant may be used for this purpose.

In still other embodiments, a two-part reacting mixture is used as the stroking material 32 in the protection assembly 100. The material that binds fibers in the resistance layer is a two-part reacting mixture, an aerobic curing material, or some other curing material, such as one that reacts with water, as in a cyanoacrylate monomer (also known as "Super Glue").

Although the stroking material 32 of the multilayered ballistic protection assembly 100 is designed to deflect ballistic impacts due to a weather event, the enclosure 40 also provides some ballistic protection, in some embodiments. In addition to constraining the shape of the stroking material 32, the enclosure 40 protects against punctures by flying objects and provides a measure of load absorption (impact attenuation). This multilayered approach provides a high degree of protection.

Preferably, the multilayered ballistic protection assembly 100 is available in a package that is compressed for transport. Plywood is problematic, as its transported volume is the same size as its installed volume. The multilayered ballistic protection assembly 100, by contrast, is compact to transport prior to use, with the stroking material 32 being contained under pressure in a canister 28. Once the stroking material fills the volume within the enclosure 40 of the assembly, the multilayered ballistic protection assembly 100 is a lightweight, yet sturdy structure suitable for protecting a window.

Figure 5:
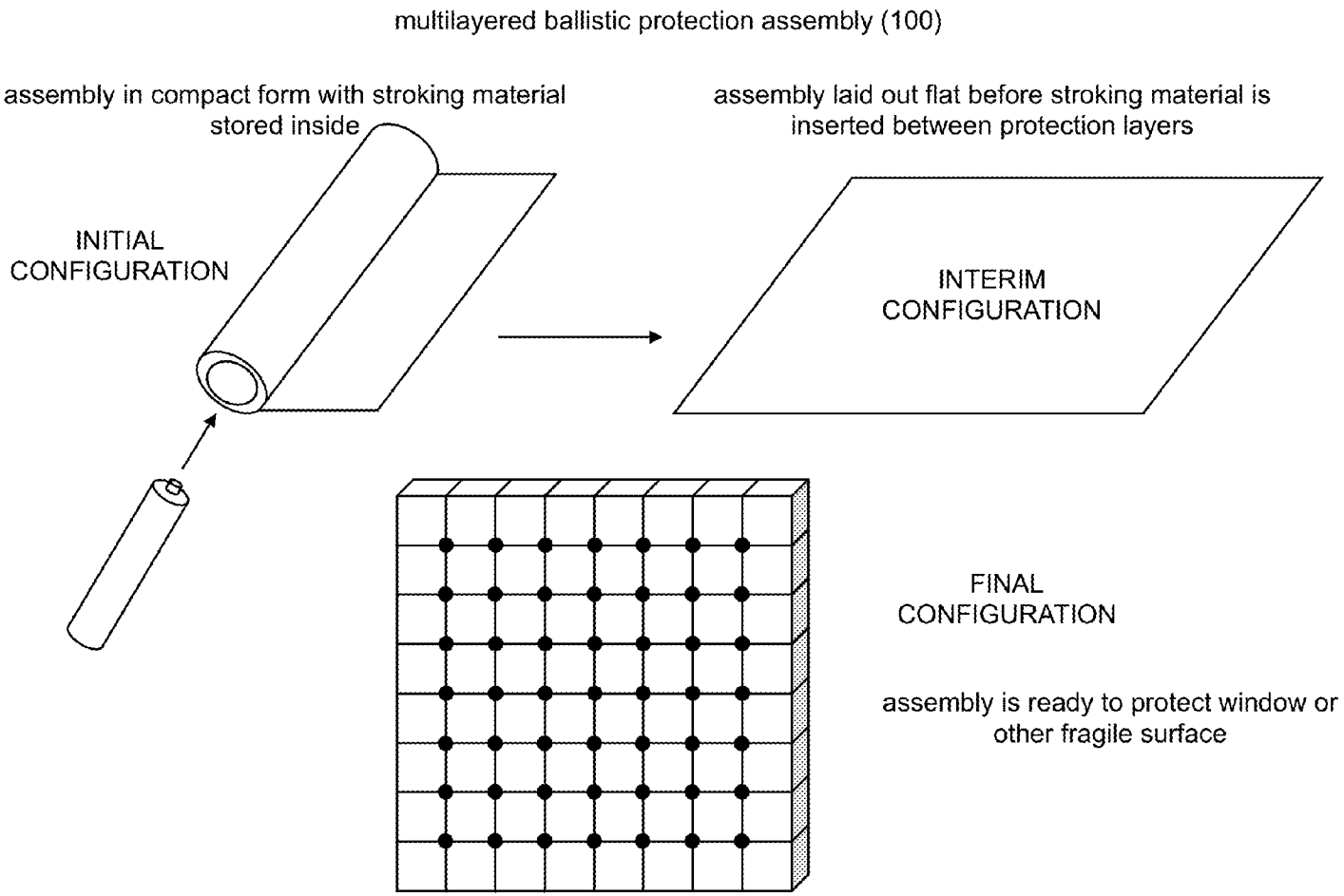
FIG. 5 is a schematic drawing of the ballistic protection assembly of FIG. 1, shown in its initial, interim, and final configurations, according to some embodiments.

FIG. 5 shows the multilayer ballistic protection assembly 100 in both its initial form (denoted, "initial configuration"), after it has been removed from its packaging (denoted, "interim configuration"), and after the stroking material has been inserted into the enclosure 40 (denoted, "final configuration"). In any of these three configurations, the protection assembly 100 is easy to manage.

In some embodiments, when the multilayer ballistic protection assembly 100 is in its initial configuration, the enclosure 40 is folded to minimize its surface area relative to its volume. This makes the assembly 100 in its initial configuration smaller than it will be in its final configuration, thus being more transportable for the consumer. When unfurled into its interim configuration, the enclosure 40 is preferably flexible. When the stroking material 32 is activated within the enclosure 40, the enclosure 40 becomes stiff in its final configuration.

Materials that change shape and develop stiffness when laid flat, such as is characteristic of many leaf springs, may be used for the protection layers, in some embodiments. In this embodiment, the protection layers 22 and 24 may be made using a metallic-based fabric or other material that is capable of stiffness. When being rolled out from the initial configuration to the interim configuration, the protection layers 22 and 24 would spring into a curved shape, hence becoming stronger and less flexible.

The multilayered ballistic protection assembly 100 is advantageous over the traditional plywood remedy for window protection because of the multiple configurations depicted in FIG. 5. By controlling the shape of the protection layers 22, 24, particularly the ability of the layers to be flattened and thus consume less space in the initial and interim configurations, the assembly 100 is more compact to transport. Further, by transforming the assembly 100 into its final configuration only when needed, such as just before a hurricane, a consumer can purchase, transport, and store the assembly in its initial configuration at the property site well in advance of a weather event.

The first and second protection layers 22, 24 of the configuration depicted in FIG. 1 are resistant to the penetration of a flying object, as is the stroking material embedded between the two layers. Controlling the resisting layers' shape assures that the minimum amount (volume) of material is used to protect the surface. It also allows for surfaces generated by intersecting spline curves to be protected. In some embodiments, the multilayer ballistic protection assembly 100 in its initial configuration is a dense package that takes up the least amount of space, relative to other solutions. The stroking space between the two layers 22, 24, when filled with the stroking material 32, contributes to the structural integrity of the assembly 100, but, prior to being used, is entirely contained in the canisters 28 or other delivery system, whether contained inside the enclosure or outside the enclosure prior to delivery. The stroking material may either be compressed, as in the case of the canned foam, or may be created by the reaction of uncompressed liquids to a catalyst or other agent that causes the reagent to fill the enclosure and harden. In other cases, the stroking material may be compressed as a foam, installed in the enclosure 40, which then expands and assumes a larger volume when restraints are released.

The multilayered ballistic protection assembly 100 imitates the deflection and absorption approach of a micro-meteor and orbital debris (MMOD) shield. The realm of the impact velocities and impact energies due to a hypervelocity particle and a low velocity board or rock may be different. The design features of the multilayer ballistic protection assembly 100 protect against a variety of damages, both expected and unforeseen.

Figure 6:
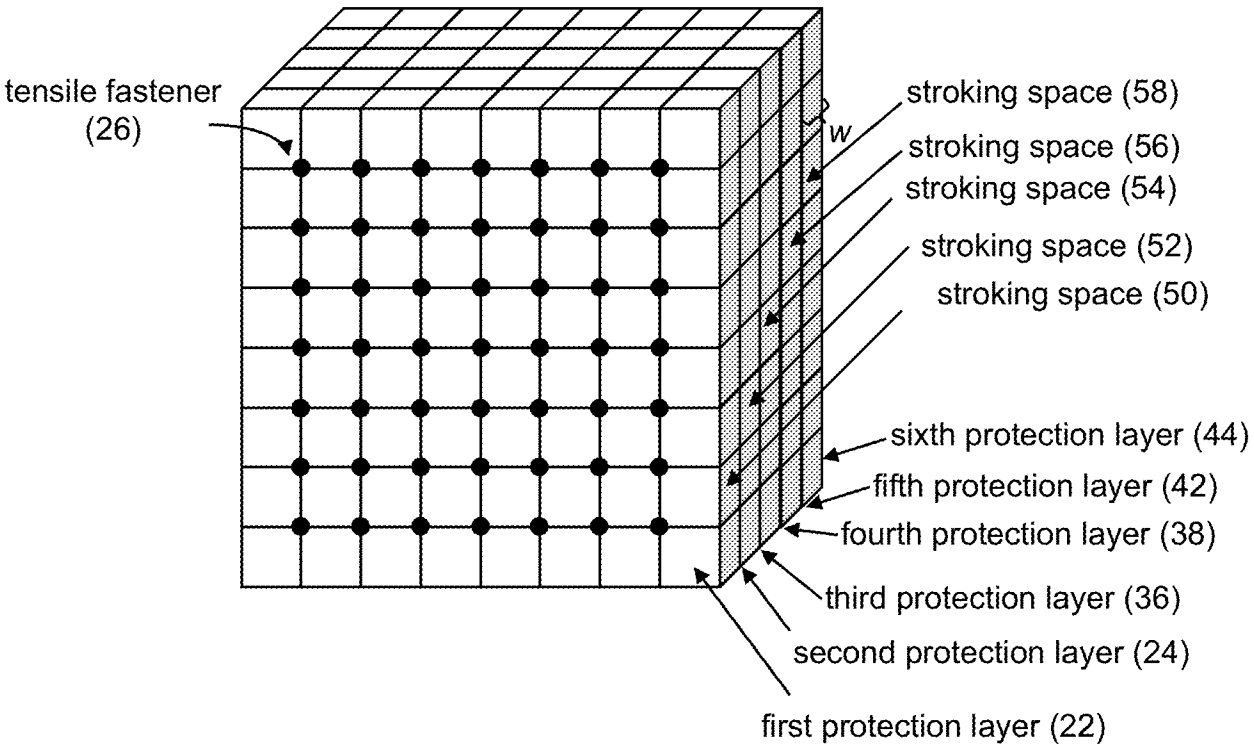
FIG. 6 is a schematic diagram of a ballistic protection assembly having more than two protection layers, according to some embodiments.

The number of protection layers and stroking spaces can vary, in some embodiments, for to protect an object. In FIG. 6, a protection assembly 100A has six protection layers surrounding five stroking spaces. Protection layers 22 and 24 surround stroking space 50; protection layers 24 and 36 surround stroking space 52; protection layers 36 and 38 surround stroking space 54; protection layers 38 and 42 surround stroking space 56; and protection layers 42 and 44 surround stroking space 58.

In some embodiments, the width, w, of each stroking space in the multilayered ballistic protection assembly 100A is varied. Thus, each stroking space is characterized by its own set of tensile fasteners 26. The tensile fasteners 26 for the stroking space 50 may be wider or narrower than the tensile fasteners 26 for the stroking space 52, and so on. In other embodiments, the width, w, of each stroking space is the same. In this case, each stroking space may have its own tensile fasteners 26, with each set of tensile fasteners being the same length, or a single set of tensile fasteners may extend from the first protection layer 26 to the last protection layer, in this case, the sixth protection layer 44.

Figure 7:
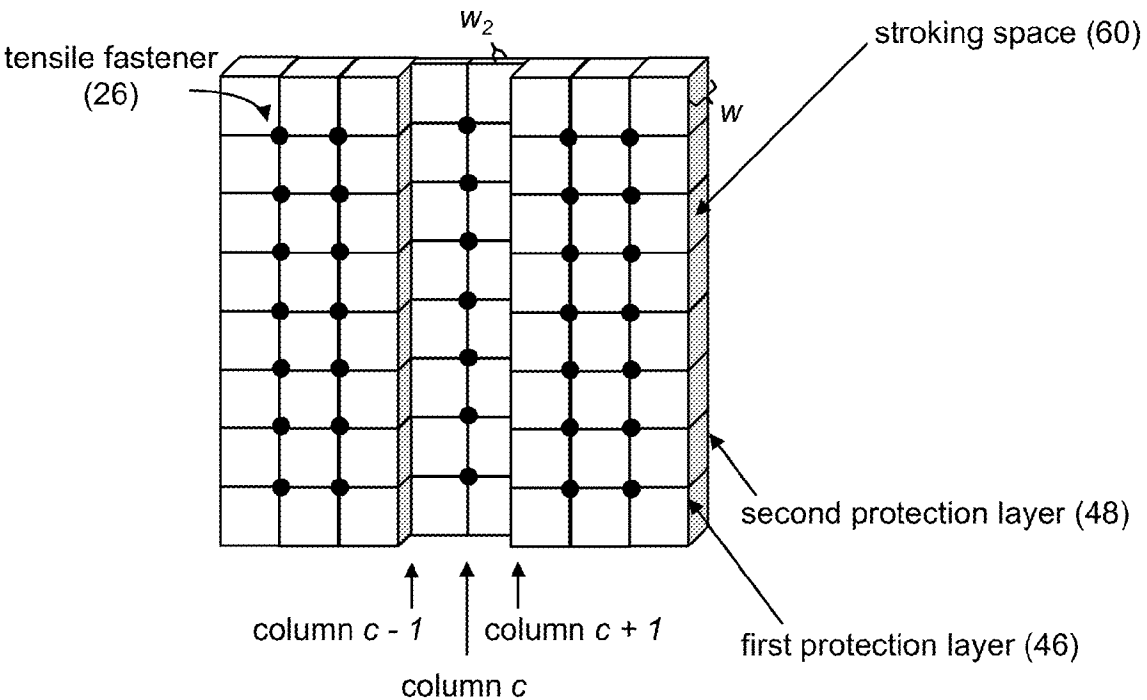
FIG. 7 is a schematic diagram of a ballistic protection assembly having protection layers that are not uniform in width, according to some embodiments.

In still other embodiments, the stroking space between two protection layers is not uniform. As depicted in FIG. 7, a multilayered ballistic protection assembly 100B includes two protection layers 46, 48, with a stroking space 60 between the two layers. While part of the stroking space has a width, w, the center of the stroking space has a width, $w_2$, where $w_2<w$. The varying width of the stroking space can be achieved using shorter tensile fasteners 26 along the column, c, as well as in columns, c−1 and c+1. The assembly 100B may be preferred for windows with non-uniform surfaces, separation between glass pieces, and so on. Sliding glass doors, for example, typically have metal bracing between the pieces of glass, and may be more fully protected with the assembly of FIG. 7. In some embodiments, the number of layers and their thickness varies according to the materials used and the energy to be absorbed.

In addition to protecting a window or other fragile surface during a weather event, the multilayered ballistic protection assembly 100 may be used as insulation. Storm events are often followed by loss of electric power to a property. By using the assembly 100 as insulation after the storm, the property temperature may be maintained for a much longer time period than without such protection. The assembly 100 may also be used as attic or crawlspace insulation for a longer time period. The removable attic insulation may then be retrieved and used to protect the windows during subsequent weather events. Plywood stored in the attic provides no substantial additional insulation, but takes up space nevertheless. The assembly 100, by contrast, may provide additional insulation to the property while being stored.

In some embodiments, the multilayered ballistic protection assembly 100 is usable as a flotation device. This may be particularly useful following a severe storm event, where flooding may damage the structure being protected and may even put the residents' lives at risk. Where the stroking material 32 is made using a closed cell foam (or an open cell foam that is sufficiently contained within a water-resistant bladder), the assembly 100 makes a sturdy flotation device. Smaller assemblies may be used to protect valuable objects, pets, and young children, while large-window assemblies have sufficient strength to protect adults, in some embodiments. The assembly 100 may also be used where flooding removes topsoil, creating muddy and sometimes precarious land surfaces, making ingress and egress of the property problematic for its residents.

In still other embodiments, the multilayered ballistic protection assembly 100 may be used as static barriers, such as a rapid deployment retaining wall used to protect against a mudslide.

Figure 8:
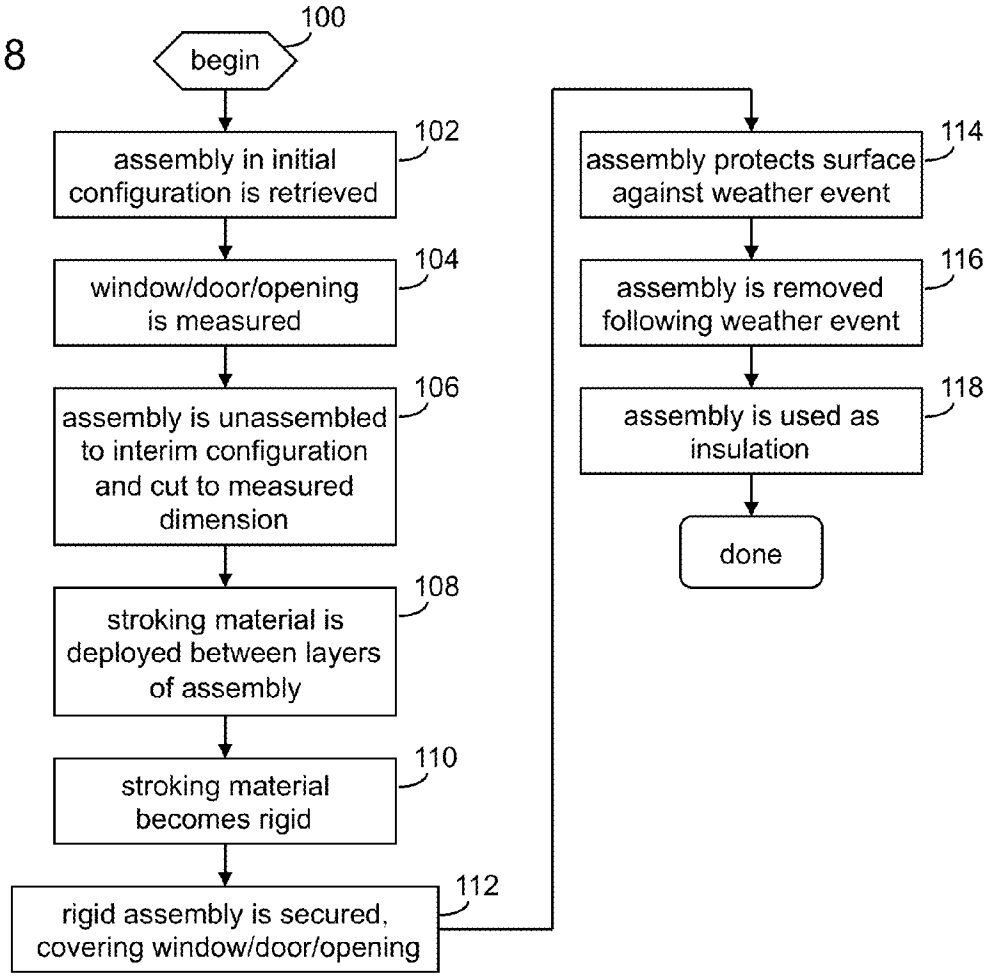
FIG. 8 is a flow diagram describing operations performed by a user of the multilayered ballistic protection assembly of FIG. 1, according to some embodiments.

FIG. 8 is a flow diagram showing how the multilayered ballistic protection assembly 100 is used, according to some embodiments. The assembly 100 in its initial configuration (see FIG. 5) is first retrieved (block 102). Due to its relatively small volume, the assembly 100 may have been previously purchased and stored for later use. The window or door or other opening is then measured (block 104). The assembly 100 is then laid out flat into its interim configuration (see FIG. 3) and is cut to fit the measured size (block 106). The assembly 100 may be cut using a knife, scissors, or other cutting implement. In some embodiments, the assembly is pre-cut such that the consumer may "tear" a portion of the measured size, without need for cutting tools. In other embodiments, the assembly is cut after the stroking material is deployed inside the enclosure 40.

Once the portion of the assembly needed for the surface to be protected has been obtained, the stroking material is deployed between the layers of the assembly 100 (block 108). Where a multiple-layered assembly is used, such as the assembly 100A of FIG. 6, stroking material is inserted under pressure to one of the stroking spaces, followed by insertion into a second stroking space, and so on, until all stroking spaces have been filled with stroking material. Once the stroking material 32 becomes rigid (block 110), the assembled configuration, now a rigid structure, is affixed to the window, door, or open surface (block 112). In some embodiments, the stroking material 32 may be deployed after the interim assembly is attached to the protected object.

In some embodiments, the multilayered ballistic protection assembly 100 is affixed to the window, door, or other surface using a fastening means that prevents the assembly 100 from moving due to negative pressure or shearing loads. Methods to prevent these movements include adhesives, double-ended feather boards, screws, nails, staples, wedge-shaped objects, etc. The multilayered ballistic protection assembly 100 provides a layered approach using resistance layers (the stroking material 32) to absorb energy and deflection areas (the protective layers 22, 24) to allow for large deflections of the resistance layer without allowing damage to the projected object. The number of layers used will depend on the desired level of protection versus the strength of the materials used. In comparison to other ballistic protection materials, chiefly plywood, the assembly 100 is of a significantly lighter weight, easier to transport and store, and is rendered into its assembled configuration using only common household tools. Further, the assembly 100 provides a secondary benefit following the weather event and may be used for subsequent weather events if maintained in its assembled configuration undamaged.

The multilayered ballistic protection assembly 100 uses resistance layers separated by a stroking volume that allows the resistance layers to move without causing damage to the window glass, door, or other structure being protected. The assembly 100 may be pre-fabricated as a panel and purchased in its final form (final configuration). Alternatively, the assembly 100 may be packaged in a reduced volume (initial configuration) until needed, and then may be unrolled (interim configuration) and cut to size.

Figure 9A:
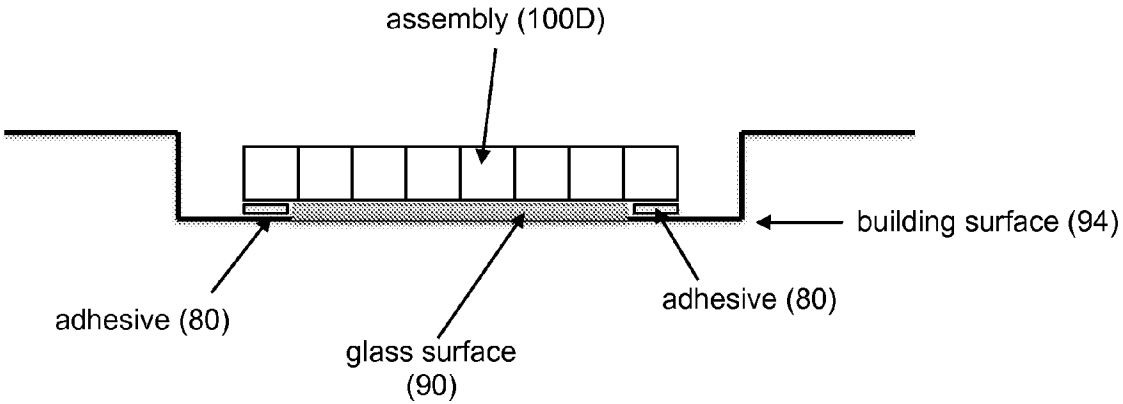
FIGS. 9A, 9B, 10A, and 10B are schematic diagrams of the multilayered ballistic protection assembly being affixed to a glass surface, according to some embodiments.
Figure 9B:
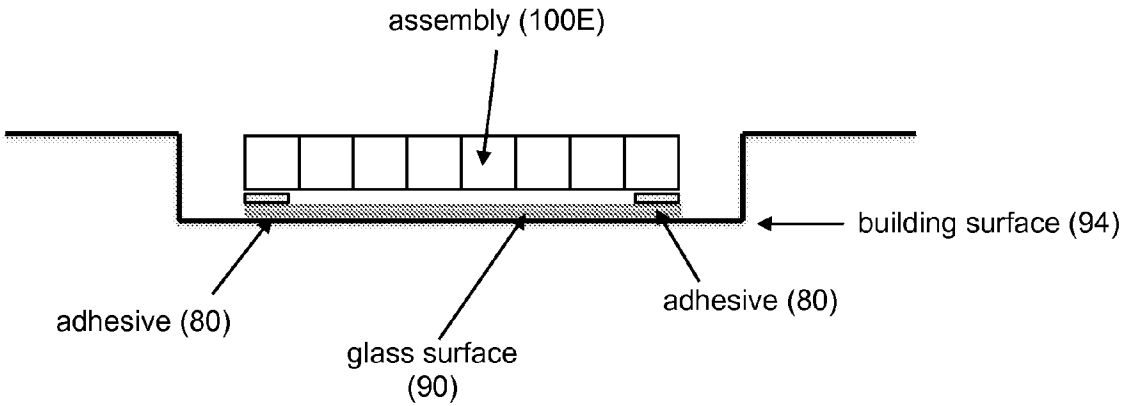

FIGS. 9A, 9B, 10A, and 10B illustrate different embodiments for affixing the assembly 100 to a window, according to some embodiments. In the side view of FIG. 9A, the multilayered ballistic protection assembly 100D is longer than the glass surface 90 it is designed to protect. Adhesives 80 are affixed between the assembly 100D and the building surface 94. Although two adhesives 80 are shown, there may be any number of adhesives used to secure the assembly 100 against the glass surface 90. In FIG. 9B, the multilayered ballistic protection assembly 100E has the same length as the glass surface 90. The adhesives 80 are thus applied directly to the glass surface 90, disposed between the glass and the assembly.

Figure 10A:
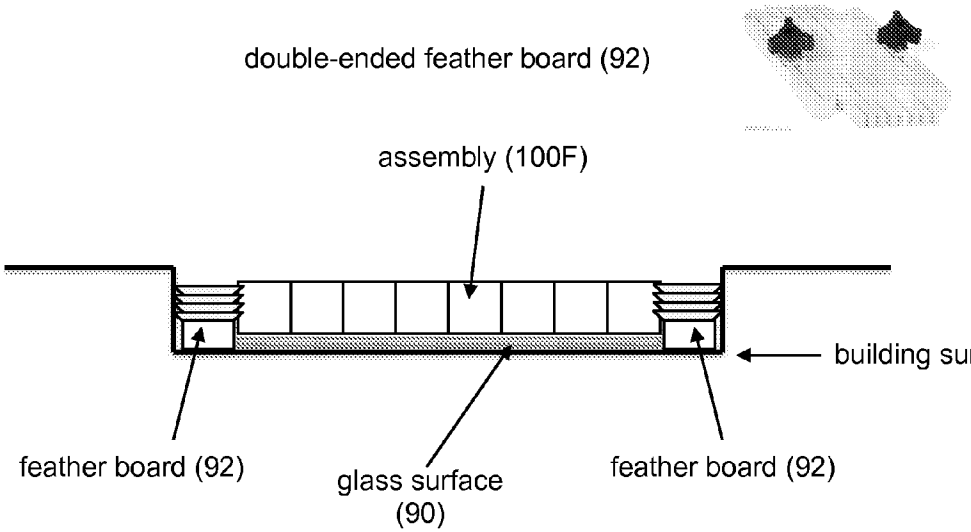
Figure 10B:
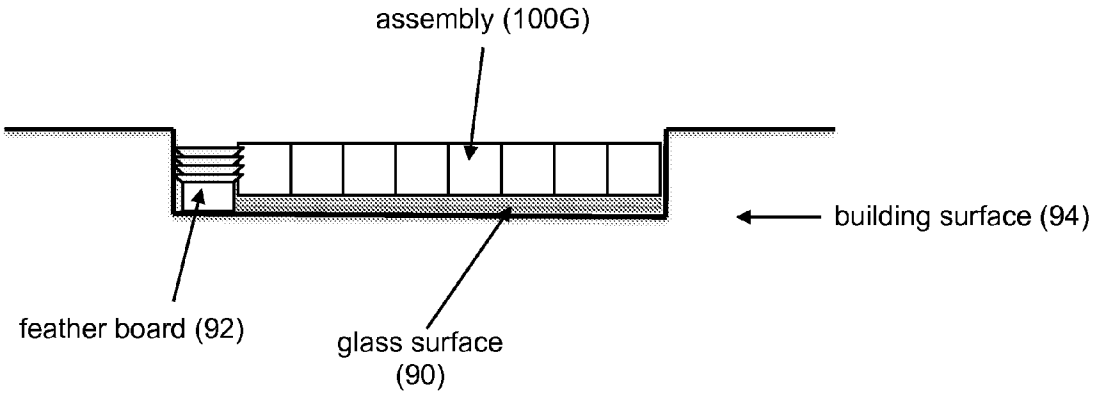

In FIGS. 10A and 10B, the space between the glass surface 90 and the building surface 94 is used to hold the multilayered ballistic protection assembly 100F against the glass surface 90. Two double-ended feather boards 92 or other wedge-like structures fit snugly between each side of the assembly 100F and the building surface 94 in FIG. 10A. During a weather event in which the assembly 100 attempts to move relative to the protected surface, the double-ended feather boards 92 apply a side load to the enclosure 40, preventing displacement of the assembly. In FIG. 10B, a single double-ended feather board 92 is used to hold the assembly 100G flush against the glass surface 90. Designers of ordinary skill in the art will recognize a variety of mechanisms for securing the multilayered ballistic protection assembly 100 against the glass surface being protected.

Figure 11:
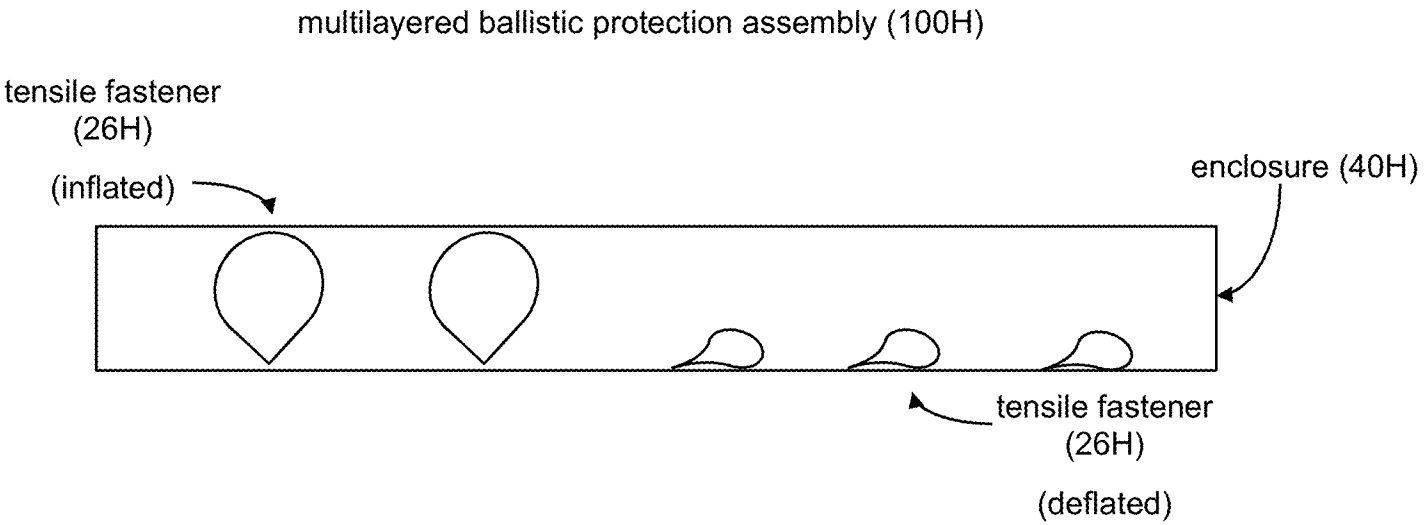
FIG. 11 is a side view of a multilayered ballistic protection assembly having inflatable tensile fasteners, according to some embodiments.

In some embodiments, the tensile fasteners 26 are not simply used to maintain a predetermined distance between the protection layers 22, 24, but are also used to provide pathways that affect the distribution of stroking material 32 within the enclosure 40. For example, the tensile fasteners 26 may be expandable bladders or other balloon-like structures that may be filled with a gas to create volume within the enclosure 40, allowing the stroking material 32 to assume other regions of the enclosure not occupied by the gas. FIG. 11 is a side view of a multilayered ballistic protection assembly 100H in which the tensile fasteners 26H are inflatable. The stroking material 32 and the gas-filled tensile fasteners may form a lattice structure, as one example. When the tensile fasteners 26H are not filled with gas, they lay flat against the bottom of the enclosure 40H. When filled with gas, the tensile fasteners 26 assume some volume of the enclosure space. In this way, the stroking material 32 may be distributed strategically through the enclosure 40H, such as where uneven surfaces are to be protected. Or, the voids created by the bladder-like tensile fasteners 26 may result in less stroking material being used. The tensile fasteners 26H in this configuration are thus used to both maintain the shape of the enclosure 40H and to supply some of the stroking volume of the enclosure.

Figure 12A:
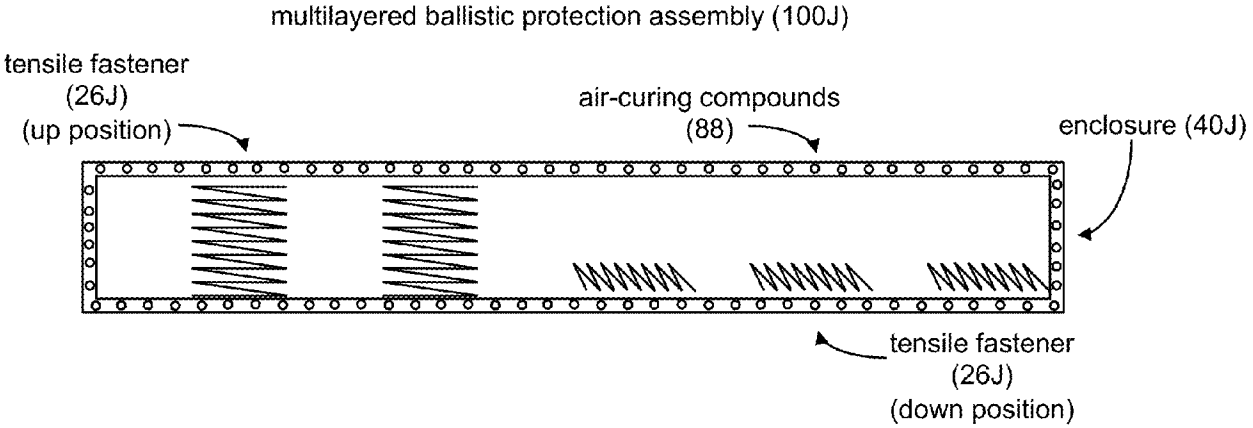
FIGS. 12A and 12B are side views of a multilayered ballistic protection assembly having spring-like tensile fasteners and air-curing compounds, according to some embodiments.
Figure 12B:
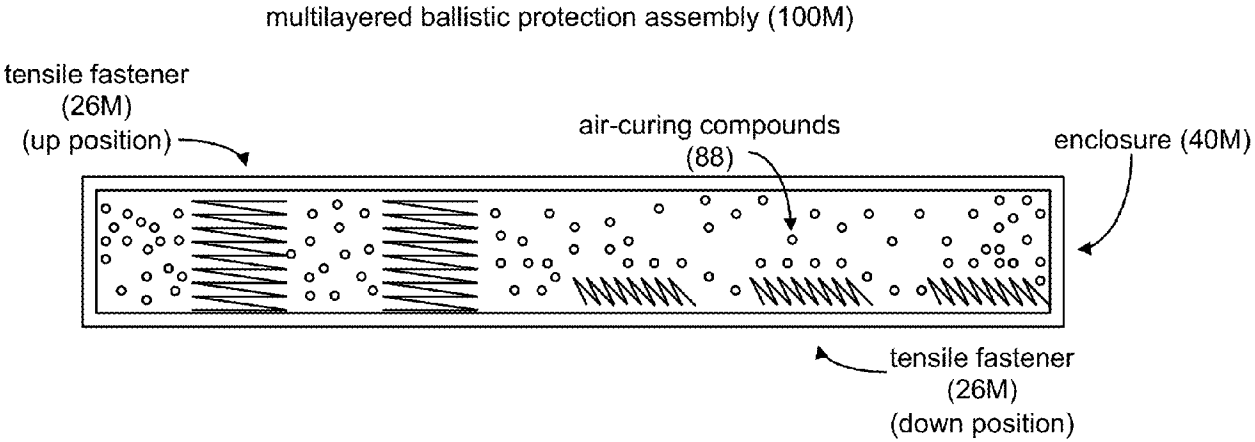

FIG. 12A is a side view of a multilayered ballistic protection assembly 100J, according to some embodiments. In this embodiment, the enclosure 40J is saturated with air-curing compounds 88, which are embedded within the protection layers of the enclosure 40J. In other embodiments, the air-curing compounds 88 are attached to the protection layers of the enclosure 44J. In still other embodiments, as depicted in FIG. 12B, the fluid-curing compounds 88 (gas or liquid) are free-floating within the enclosure 40M. (Because of the fluid-curing properties of these compounds 88, the enclosure 40J is compressed and packaged in an air-tight container in its initial configuration.) Within the enclosure 40J, the tensile fasteners 26J are springs that operate as both tensile fasteners and as stroking material. When air is allowed into the enclosure 40J, the springs move up from a down position to an up position, forcing the enclosure 40J into a preprogrammed shape. Further, because of the air-curing compounds 88, the enclosure 40J cures and become rigid.

In other embodiments, the multilayered ballistic protection assembly 100 may include the tensile fasteners that are springs (as in the tensile fasteners 26J and 26M of FIGS. 12A and 12B, respectively), but not include the air-curing compounds. In this configuration, the springs would not be activated by air, but would move from the down to up position by some other means. The assembly 100 may receive stroking material from an external source, such as a canister, as in FIG. 1, or may include a two-part compound that is located inside the enclosure, as described above. In still other embodiments, the assembly 100 may include the bladder-like tensile fasteners combined with the air-curing compounds. Designers of ordinary skill in the art will recognize a number of different combinations that may be used in constructing a multilayered ballistic protection assembly based on the many embodiments described herein.

While the application has been described with respect to a limited number of embodiments, those skilled in the art will appreciate numerous modifications and variations therefrom. It is intended that the appended claims cover all such modifications and variations as fall within the true spirit and scope of the invention.

I claim:

1. A multilayered ballistic protection assembly comprising:

an enclosure comprising a flexible material, the flexible material comprising a first protection layer and a second protection layer, wherein the first protection layer and the second protection layer are substantially similar in size, the flexible material being stowable in an initial configuration, unfurlable into an interim configuration, and transformed into a substantially rigid material able to attenuate ballistic impact in a final configuration;

a stroking material to absorb energy and transfer impact loads across the enclosure, wherein the stroking material, once inside the enclosure, transforms the enclosure into the substantially rigid material capable of resisting the ballistic impact; and a plurality of tensile fasteners secured inside the enclosure between the first protection layer and the second protection layer, wherein the plurality of tensile fasteners comprise expandable bladders that are filled with the stroking material when the stroking material is deposited inside the enclosure, the stroking material and the plurality of tensile fasteners in the enclosure forming a lattice structure capable of resisting the ballistic impact;

wherein the tensile fasteners provide structural continuity between layers within the enclosure and ensures that the enclosure, in its final configuration, maintains a preprogrammed shape.

2. The multilayered ballistic protection assembly of claim 1, the flexible material further comprising:

a surrounding protection layer to attach between the first and second protection layers.

3. The multilayered ballistic protection assembly of claim 1, wherein the enclosure folds into a minimum exposed surface area to volume ratio in the initial configuration.

4. The multilayered ballistic protection assembly of claim 1, wherein the enclosure unfurls into a flexible shape in the interim configuration.

5. The multilayered ballistic protection assembly of claim 1, wherein the enclosure assumes a rigid shape in the final configuration.

6. The multilayered ballistic protection assembly of claim 1, wherein the tensile fasteners comprise tension only structural members.

7. The multilayered ballistic protection assembly of claim 1, wherein the tensile fasteners comprise tension or compression structural members.

8. The multilayered ballistic protection assembly of claim 1, wherein the stroking material comprises a closed cell rigid foam.

9. The multilayered ballistic protection assembly of claim 1, further comprising:

a stroking material delivery system comprising the stroking material in a compressed form, the stroking material delivery system to be coupled to the enclosure by a receiving means;

wherein the stroking material is delivered under pressure to inside the enclosure.

10. The multilayered ballistic protection assembly of claim 9, wherein the stroking material expands or hardens when delivered into the enclosure.

11. The multilayered ballistic protection assembly of claim 1, further comprising:

a third protection layer, wherein the first and second protection layer form a first enclosure and the second and third protection layer form a second enclosure.

12. The multilayered ballistic protection assembly of claim 11, further comprising:

a second plurality of tensile fasteners disposed between the second protection layer and the third protection layer, wherein the second plurality of tensile fasteners are of a different length than the first plurality of tensile fasteners.

13. The multilayered ballistic protection assembly of claim 1, wherein a portion of the tensile fasteners are a first length and a second portion of the tensile fasteners are a second length, such that the enclosure formed by the first and second protection layers is not uniform in width.

14. The multilayered ballistic protection assembly of claim 1, wherein the tensile fasteners comprise metal pieces that are curved in a free state, but are capable of laying flat.

15. The multilayered ballistic protection assembly of claim 14, each tensile fastener further comprising:

an expandable spring that is disposed in a downward position of reduced volume when the assembly is in an initial configuration, but assumes an upward position of increased volume in an assembled configuration.

16. The multilayered ballistic protection assembly of claim 1, wherein the stroking material resides within the enclosure and, upon activation, fills the enclosure and hardens.

17. The multilayered ballistic protection assembly of claim 16, wherein the stroking material contained within the enclosure is activated either chemically or mechanically.

18. The multilayered ballistic protection assembly of claim 16, further comprising:

a plurality of tensile fasteners disposed between layers of the enclosure, the tensile fasteners ensuring that the enclosure maintain a preprogrammed shape.

19. The multilayered ballistic protection assembly of claim 18, each tensile fastener further comprising:

an expandable bladder to receive a gaseous substance, the expandable bladder to occupy some volume within the enclosure.

20. The multilayered ballistic protection assembly of claim 1, further comprising:

an adhesive for affixing the enclosure to a glass surface.

21. The multilayered ballistic protection assembly of claim 1, further comprising:

a double-ended feather board for affixing the enclosure to a glass surface.

22. The multilayered ballistic protection assembly of claim 1, the tensile fasteners further comprising:

tension-only fasteners, wherein the tension-only fasteners resist tensile loads on the enclosure.

23. The multilayered ballistic protection assembly of claim 1, the tensile fasteners further comprising:

tension and compression fasteners, wherein the tension and compression fasteners resist tensile loads and compression loads on the enclosure.

* * * * *